United States Patent [19]

Putz et al.

[11] Patent Number: 5,016,433

[45] Date of Patent: May 21, 1991

[54] METHOD AND APPARATUS FOR MONITORING, GRASPING AND RELEASE OF YARN TUBES BY AN AUTOMATIC BOBBIN CHANGER FOR A TEXTILE RING SPINNING OR TWISTING MACHINE

[75] Inventors: Oliver Putz, Ostfildern; Herbert Konig, Ebersbach/Fils, both of Fed. Rep. of Germany

[73] Assignee: Zinser Textilmaschinen GmbH, Fed. Rep. of Germany

[21] Appl. No.: 425,428

[22] Filed: Oct. 23, 1989

[30] Foreign Application Priority Data

Oct. 25, 1988 [DE] Fed. Rep. of Germany ..... 3836330

[51] Int. Cl.[5] ..... D01H 9/02

[52] U.S. Cl. ..... 57/264; 57/274

[58] Field of Search ..... 57/264, 266, 267, 273, 57/274, 275, 281

[56] References Cited

U.S. PATENT DOCUMENTS

| | | | |
|---|---|---|---|
| 3,751,895 | 8/1973 | Anderson et al. | 57/274 |
| 3,791,124 | 2/1974 | Kaufmann et al. | 57/274 |
| 4,333,411 | 6/1982 | Lerner . | |
| 4,527,496 | 7/1985 | Kemmel . | |
| 4,660,370 | 4/1987 | Matsui et al. | 57/281 |

FOREIGN PATENT DOCUMENTS

| | | |
|---|---|---|
| 2226077 | 12/1972 | Fed. Rep. of Germany . |
| 2412288 | 2/1975 | Fed. Rep. of Germany . |
| 2536435 | 2/1977 | Fed. Rep. of Germany . |
| 2922499 | 12/1979 | Fed. Rep. of Germany . |
| 3032584 | 6/1982 | Fed. Rep. of Germany . |
| 3321261 | 10/1985 | Fed. Rep. of Germany . |
| 3528294 | 8/1988 | Fed. Rep. of Germany . |

*Primary Examiner*—Joseph J. Hail, III

*Attorney, Agent, or Firm*—Shefte, Pinckney & Sawyer

[57] ABSTRACT

A method and apparatus for monitoring the proper grasping and release of yarn tubes by an automatic bobbin changer in removing fully-wound yarn tubes from, and placing empty replacement yarn tubes onto, the spindles of an associated ring spinning machine or ring twisting machine. After an operation of the bobbin changer for either grasping or releasing yarn tubes, a light beam is directed through an area previously occupied by the tubes, a determination is made whether the light beam is interrupted by any tube which the bobbin changer failed to grasp or release, and if so, a failure signal is generated to interrupt continued operation of the bobbin changer.

25 Claims, 6 Drawing Sheets

FIG. 18III

METHOD AND APPARATUS FOR MONITORING, GRASPING AND RELEASE OF YARN TUBES BY AN AUTOMATIC BOBBIN CHANGER FOR A TEXTILE RING SPINNING OR TWISTING MACHINE

BACKGROUND OF THE INVENTION

The present invention relates generally to methods and apparatus for automatically replacing fully wound yarn tubes on a textile ring spinning machine, ring twisting machine or like textile machine with empty yarn tubes and, more particularly, to a method and apparatus for monitoring the proper operation of an automatic bobbin changer for grasping and releasing yarn tubes in executing the exchange procedure.

Automatic bobbin changers are known which are operable to simultaneously grasp a plurality of yarn tubes at either or both the spindles of a textile ring spinning or twisting machine or the support pins of a tube supply arrangement and for subsequently releasing the grasped tubes to execute a simultaneous replacement of all spinning tubes in yarn winding operation on the textile machine with a corresponding number of empty yarn tubes. In executing this operation, a risk exists that the automatic bobbin changer may fail to properly grasp one or more of the yarn tubes to be grasped or may fail to properly release one or more of the yarn tubes previously grasped.

Specifically, if one or more fully wound yarn tubes (commonly referred to as bobbins) to be doffed from the spindles of a ring spinning or ring twisting machine are not grasped and removed from the spindles by the automatic bobbin changer, the tube or tubes remaining on the spindles will obstruct the bobbin changer from properly carrying out the subsequent placement of an empty tube or tubes on the affected spindles, necessarily resulting in damage to the tubes and perhaps also to the textile machine and the bobbin changer with an attendant undesirable down time in the normal operation of the machine.

West German Offenlegungschrift 2 226 077 discloses the provision of a light beam passing through the area of a textile machine occupied by fully wound tubes to be withdrawn for purposes of detecting an interruption in the light beam and generation cf a machine stoppage signal when a tube remains on a spindle of the machine after the withdrawal operation.

Likewise, if an automatic bobbin changer fails to properly release one or more tubes grasped by the changer, the non-released tube or tubes will obstruct and collide with another tube or tubes during subsequent attempted operation of the bobbin changer to grasp another tube or tubes, also causing damage to the tubes and possibly to the bobbin changer and the textile machine. If the bobbin changer fails to grasp an empty tube, the changer necessarily fails subsequently to place the missing empty tube onto a respective spindle of the textile machine whereby resumption of the machine operation causes yarn to be wound about the bare spindle, removal of which is difficult, time consuming and expensive to accomplish.

SUMMARY OF THE INVENTION

It is accordingly an object of the present invention to provide a method and apparatus for monitoring the tube grasping and releasing operations of an automatic bobbin changer to avoid the aforedescribed dangers and disadvantages of conventional equipment and to optimize the operation of the bobbin changer and the associated textile machine The method and apparatus of the present invention are basically adapted for monitoring any automatic bobbin changer of the type selectively operable for simultaneously grasping and simultaneously releasing a plurality of yarn tubes for selective supply and removal of yarn tubes to and from an associated ring spinning machine, ring twisting machine and like textile machines According to the method and apparatus of the present invention, after an operation of the bobbin changer for either grasping or releasing yarn tubes, at least one light beam is directed through an area previously occupied by the tubes upon which the operation was performed. A determination is made whether the light beam is interrupted by any tube upon which the bobbin changer failed to operate and, if so, a failure signal is generated and the continuing bobbin replacement procedure is interrupted. In this manner, the present method and apparatus considerably reduces the incidence of down time and the risk of damage to the tubes, the bobbin changer and/or the associated textile machine occurring when the bobbin changer fails to properly grasp or release one or more yarn tube. A suitable arrangement for generating and directing the light beam is actuated after the particular tube grasping or releasing operation of the bobbin changer, but prior to the next operation of the bobbin changer to grasp or release another set of yarn tubes.

Typically, the ring spinning machine, ring twisting machine or like textile machine with which a bobbin changer equipped with the present invention issued has a plurality of spindles for supporting yarn tubes for yarn winding thereabout and a plurality of support pins are provided, e.g. on a tube delivery conveyer or the like, for storing a plurality of empty yarn tubes for supply to the spindles of the textile machine when the active yarn tubes on the spindles become fully wound with yarn. Conventional bobbin changers include a plurality of grasping members operative for removing fully wound yarn tubes from the spindles of the associated textile machine, holding the fully wound yarn tubes after removal, and subsequently releasing the fully wound tubes onto the tube conveyer or another discharge location. Likewise, the grasping members of a bobbin changer are commonly operable for removing the empty yarn tubes stored on the support pins, holding the empty tubes after removal from the support pins, and subsequently releasing the empty tubes onto the spindles of the textile machine.

According to the present invention, a light beam may be utilized for monitoring the proper execution of each such tube grasping and releasing operation executed by the bobbin changer. Specifically, a light beam may be directed in an area adjacent the spindles occupied by the fully wound tubes while supported on the spindles before removal in order to monitor proper removal of fully wound tubes from the spindles A light beam may similarly be directed in an area adjacent the grasping members occupied by the fully wound tubes while held by the grasping members before release in order to monitor proper release of all fully wound tubes to the discharge location. A light beam may be directed in an area adjacent the tube storage support pins occupied by empty tubes while stored thereon before removal in order to monitor proper grasping of the empty tubes. Also, a light beam may be directed in an area adjacent the grasping members occupied by the empty tubes while held by the grasping members before release onto the spindles in order to determine release of all empty tubes.

In bobbin changers wherein the same grasping members are operative both to grasp empty tubes from the storage support pins and fully wound tubes from the textile machine spindles, it is sufficient to provide one light beam arrangement to selectively monitor the empty tubes and the fully wound tubes in relation to the cycle of operation of the bobbin exchange process being executed by the bobbin changer. On the other hand, with bobbin changers having separate sets of grasping members for empty yarn tubes and for fully wound yarn tubes, separate light beam arrangements should be utilized for each set of grasping members of the bobbin changer.

In all cases, the light beam arrangement must be oriented to direct its light beam through an area occupied by yarn tubes prior to grasping or release by the bobbin changer but which area should be unoccupied after proper execution by the bobbin changer of the grasping or releasing operation.

The light beam arrangement may be located stationarily in the path in which the yarn tubes are moved by the bobbin changer or alternatively on the structural component of the bobbin changer which carries its grasping members.

Preferably, the arrangement for generating and directing the light beam or beams includes a light beam transmitter and a light beam receiver. In one embodiment, the transmitter and receiver may be arranged on the structural component of the bobbin changer carrying the grasping members so as to be shiftable to direct the light beam for monitoring different areas. On the other hand, the transmitter and receiver may be mounted stationarily on the structural component of the bobbin changer, the movability of the bobbin changer being utilized to direct the light beam for monitoring different areas, including, for example, the area occupied by fully wound yarn tubes on the spindles of the associated textile machine.

In another embodiment of the present invention, the effective direction and area monitored by a light beam can be shifted without shifting the transmitter and receiver arrangement which generates the light beam by utilizing pivotably mounted mirrors arranged in pairs. For example, by utilizing three pairs of mirrors, two pairs of which may be selectively pivoted, it is possible to deflect the light beam of a single transmitter and receiver arrangement at three separate monitoring areas.

Mirrors may also be utilized to deflect the respective light beams of several individual beam transmitters, each of which is directed at respective monitoring areas, for receipt by either a lesser or greater number of beam receivers. For example, a transmitter and receiver may be located stationarily on the frame of the textile machine to direct a light beam through an area occupied by yarn tubes when supported on the machine spindles, with one or more pairs of pivoted mirrors being provided to enable selective deflection of the light beam along parallel beam paths, e.g., through areas occupied by empty yarn tubes when grasped by the bobbin changer grasping members or by fully wound yarn tubes when grasped by the grasping members. As will be understood, the areas thusly monitored by the transmitter and receiver arrangement are determined in relation to the textile machine frame.

In another embodiment of the present invention, a light beam arrangement may be mounted stationarily on the textile machine frame to be directed through an area occupied by fully wound yarn tubes on the machine spindles prior to removal. At the same time, the structural component of the bobbin changer which carries the grasping members may be provided with a light beam arrangement oriented to direct a light beam through an area occupied by empty tubes when grasped by the grasping members prior to release. The structural component may further be provided with one or more pairs of pivoted mirrors to enable selective shifting of the light beam through a parallel path to monitor an area occupied by fully wound yarn tubes while held by other grasping members of the bobbin changer prior to discharge.

It is contemplated that the various embodiments of light beam arrangements in accordance with the present invention may operate with either visible or invisible light. In ring spinning machines or ring twisting machines having particularly high numbers of spindles arranged in relatively long rows, a low-output laser beam will operate advantageously because of its well bundled beam. On the other hand, it is contemplated that a widening lens may be utilized with a laser beam to enlarge its cross-sectional area to avoid the possibility that a narrow linear laser beam may be interrupted by chance by a yarn extending from a fully wound yarn tube and thereby unnecessarily cause a stoppage of the bobbin exchange process although all yarn tubes have been properly grasped or released by the bobbin changer. It is also contemplated that light-wave guide members may be utilized for directing the light beams through the desired monitoring areas.

BRIEF DESCRIPTION OF THE DRAWINGS

FIGS. 18II(*a*) through 18II(*i*) are schematic views similar to FIGS. 18I and 18III, showing in sequence various operational stages in a bobbin exchange procedure.

DESCRIPTION OF THE PREFERRED EMBODIMENT

Figure 1:
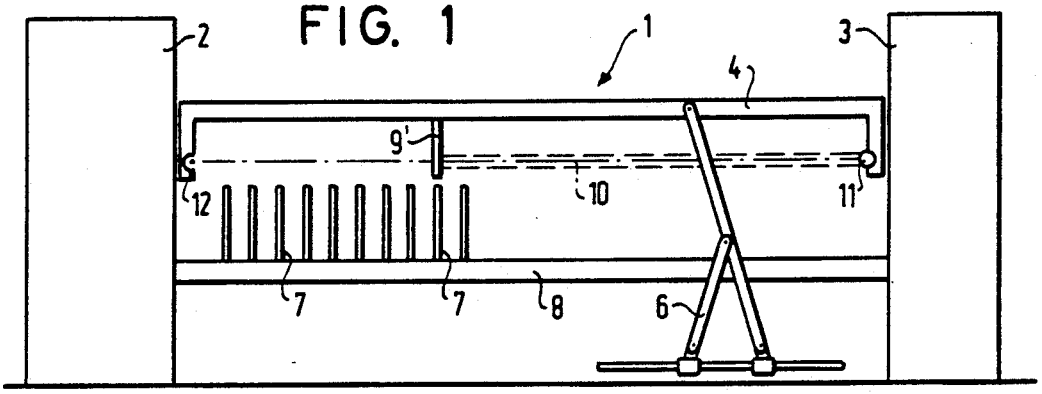
FIGS. 1–17 are schematic views illustrating various possible embodiments of the bobbin changer monitoring method and apparatus of the present invention.

Referring now to the accompanying drawings and initially to FIG. 1, a textile ring spinning machine is schematically illustrated in front elevation at 1 and basically includes laterally spaced end frame members 2, 3 between which extend spindle bearing plates 8 on which a plurality of driven spindles 7 are arranged into parallel longitudinally-extending rows. The spinning machine 1 is equipped with a bobbin changing mechanism for removing fully wound yarn tubes from, and placing new empty yarn tubes onto, the spindles 7 to enable the spinning operation of the machine to proceed on a generally continuous basis. The bobbin changer basically includes a grasper beam 4 extending substantially the length of the spindle bearing plates 8 between the end frames 2, 3 of the spinning machine 1 and an articulable lever system 6 by which the grasper beam 4 may be raised and lowered relative to the spindles 7. The lever system 6 is supported on a shaft extending longitudinally along the spinning machine 1 for actuating lateral movement of the grasper beam 4 relative to the spindles 7. The grasper beam 4 includes a plurality of tube grasping members 5 (FIGS. 4–9) selectively operable for simultaneously grasping and simultaneously releasing a corresponding plurality of yarn tubes 9. A light beam transmitter 11 and a light beam receiver 12 are mounted respectively at opposite ends of the grasper beam 4 for generating and directing a light beam 10 between the transmitter 11 and receiver 12. As illustrated in FIG. 1, the transmitter 11 and receiver 12 are positioned to direct the light beam 10 in the area occupied by yarn tubes 9′ while grasped by the grasping members of the grasper beam 4. When the grasping beam 4 has been operated to deliver and release a plurality of empty yarn tubes 9′ onto the spindles 7 of the spinning machine 1, the light beam 10 enables a determination to be made as to whether all tubes 9′ were released by the grasping member 5 of the grasping beam 4. If a yarn tube 9′ was not properly released by the grasper beam 4 and therefore remains thereon after the bobbin releasing operation, the retained tube 9′ obstructs the light beam 10 from being received by the beam receiver 12. The light beam receiver 12 is operable to generate and deliver a failure signal to an associated controller (not shown) when the light beam is thusly interrupted, and the controller is operative to stop continuing operation of the bobbin changer.

Figure 2:
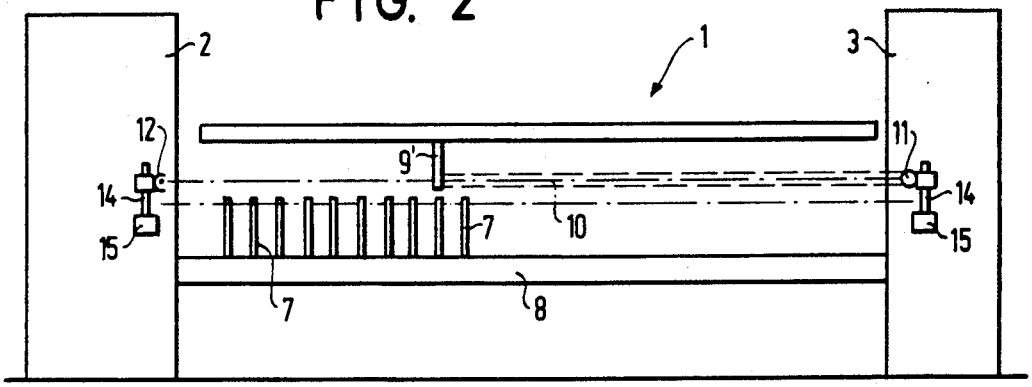

While FIG. 1 illustrates an embodiment of the present invention wherein a light beam generating and directing arrangement is located on the grasper beam 4 of a bobbin exchanger, FIG. 2 illustrates another embodiment of the present invention in a ring spinning machine 1, also shown in front elevation, wherein a light beam transmitter 11 and light beam receiver 12 are respectively mounted to the end frame members 2, 3 of the spinning machine 1 for generating and directing a light beam 10 therebetween. Each of the transmitter 11 and the receiver 12 are mounted on a threaded drive screw 14 rotatably driven by a drive motor 15 to enable selective vertical shifting movement of the transmitter 11 and receiver 12 between a position wherein the light beam 10 is directed through an area adjacent the spindles 7 which area is occupied by yarn tubes when supported on the spindles 7, thereby for monitoring and determining the presence or absence of yarn tubes on the spindles 7, and a more elevated position wherein the light beam 10 is directed through an area adjacent the grasping members of the grasper beam 4 which area is occupied by yarn tubes while held by the grasping members, thereby to monitor and determine the presence or absence of yarn tubes held by the grasper beam 4. The movements of the transmitter 11 and the receiver 12 between such positions may be arranged to take place synchronously, such as by utilizing stepping motors, or alternatively stop members, limit switches or the like may be utilized to define the differing positions of the transmitter 11 and the receiver 12 so that the drive motors 15 for the threaded drive screws 14 may be operated asynchronously.

Figure 3:
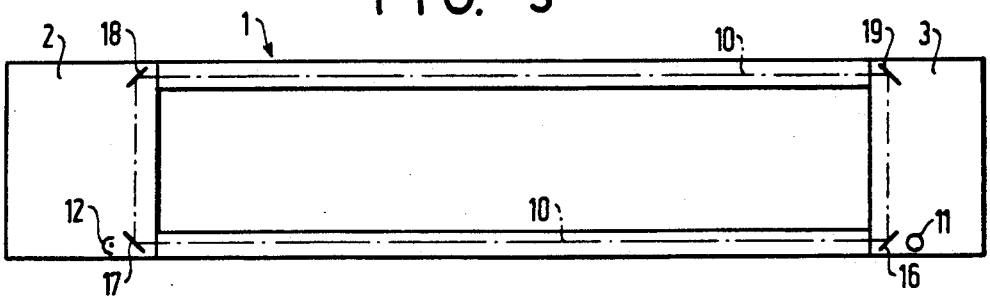

FIG. 3 shows another embodiment of the present invention in another two-sided ring spinning machine 1, shown in top plan view. In this embodiment, a single light beam transmitter 11 and a single light beam receiver 12 are mounted respectively to the end frame members 2, 3 of the ring spinning machine 1 for directing a light beam 10 in alignment with one row of spindles of the machine 1. Two sets of mirrors 16, 17 and 18, 19 are also mounted to the respective end frame members 2, 3 of the machine 1 at opposite ends of the two rows of machine spindles. The mirrors 18, 19 are fixed in angular disposition, as shown, while the mirrors 16, 17 are pivotable between the angular disposition illustrated and a pivoted disposition out of the normal path of the light beam between the transmitter 11 and receiver 12. In this manner, the light beam 10 may be utilized to monitor either row of spindles of the spinning machine 1. Specifically, with the mirrors 16, 17 pivoted out of their illustrated disposition, the light beam 10 is directed linearly from the transmitter 11 to the receiver 12 to monitor the row of spindles aligned therewith. On the other hand, by orientation of the mirrors 16, 17 as illustrated, the light beam 10 is deflected by the two pairs of mirrors 16, 17, 18, 19 to pass along the other row of spindles for monitoring and determining the presence or absence of yarn tubes thereon.

FIGS. 4 through 8 are vertical cross-sectional views taken through the grasper beam 4 and the spindle bearing plate 8 of a ring spinning machine such as shown in FIGS. 1 and 2. An area immediately above the upper ends of the spindles 7 of the machine but still within the vertical space occupied by yarn tubes while supported on the spindles 7 is indicated at A. As will thus be understood, a light beam 10 directed horizontally through the area A enables the presence or absence of fully-wound yarn tubes 13 on the spindles 7 to be monitored and determined. Thus, following an operation of the grasper beam 4 to grasp and remove fully wound yarn tubes 13 from the machine spindles 7 by the grasper members 5, it can be determined whether all fully wound tubes 13 were properly removed or one or more full tubes 13 improperly remain on the spindles 7.

Another area directly below the grasper members 5 of the grasper beam 4 but still within the vertical space occupied by empty yarn tubes 9 when held by the grasper members 5 is indicated at B. As will be understood, the direction of a light beam 10 horizontally through the area B enables the presence or absence of yarn tubes 9 retained by the grasper members 5 to be monitored and determined. Thus, following an operation of the grasper beam 4 to release empty yarn tubes 9 from the grasper members 5, it can be determined whether all yarn tubes 9 were properly released or one or more yarn tubes were improperly retained by the grasper beam 4.

Another area, immediately beneath the grasping members 5 of the grasper beam 4 but still within the vertical area occupied by fully wound yarn tubes 13 held by the grasping members 5 after removal from the spindles 7 of the spinning machine, is indicated at C. By passage of a light beam 10 through the area C, the presence or absence of fully wound bobbins 13 retained by the grasping members 5 may be monitored and determined. Thus, following an operation of the grasper beam 4 to release fully wound yarn tubes 13 after previous removal from the spindles 7 of the spinning machine, it is possible to determine whether all full yarn tubes 13 were properly released by the grasping members 5 or one or more full tubes 13 were improperly retained.

Figure 4:
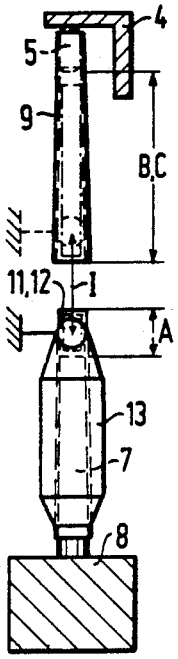

In the embodiment illustrated in FIG. 4, the grasper beam 4 is provided with one set of grasping members 5 which are operative both to grasp and remove fully wound yarn tubes 13 from the spindles 7 of the spinning machine and also to grasp and release for delivery onto the spindles 7 empty replacement yarn tubes 9. Accordingly, in this embodiment, the monitoring areas B and C coincide in relation to the grasper beam 4. In this embodiment, one light beam transmitter 11 and one light beam receiver 12 are provided and are arranged to be shiftable vertically between the areas A and B, C by a distance indicated by the arrow I for selectively directing the light beam 10 through either of the two areas for monitoring and determining the presence or absence of yarn tubes 9, 13.

Figure 5:
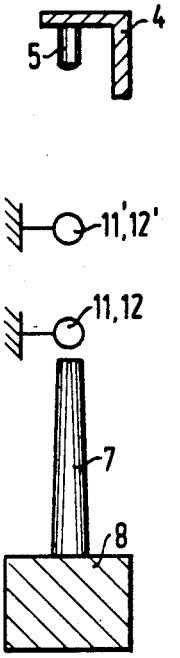

In the embodiment of FIG. 5, two pairs of associated light beam transmitters and receivers 11, 12 and 11', 12' are stationarily mounted on the end frame members (not shown) of the spinning machine at vertical spacings from one another for directing their respective light beams through the area A and the area B, C. As will be understood, since the transmitter 11' and the associated receiver 12' are mounted to the machine frame, it is possible to effectively monitor the area B, C only when the grasper beam 4 is positioned within the area between the end frame members of the ring spinning machine directly above the spindles 7, as shown in FIG. 5.

Figure 6:
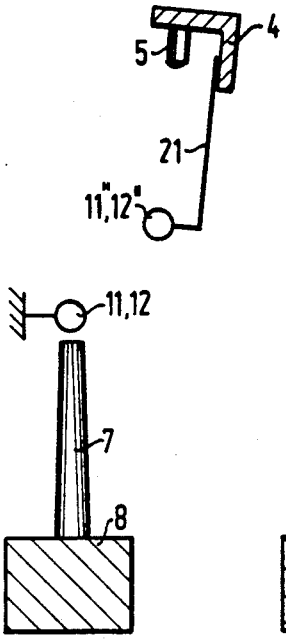

In the embodiment of FIG. 6, a light beam transmitter 11 and an associated light beam receiver 12 are stationarily affixed to the spinning machine frame within the area A, as in FIG. 5, and another light beam transmitter 11'' and an associated light beam receiver 12'' are mounted by an arm 21 to the grasper beam 4 immediately beneath the grasping members 5 within the area B, C. Thus, since in this embodiment the transmitter 11'' and receiver 12'' are mounted to and moved with the grasper beam 4, the light beam therebetween can be utilized to monitor the area B, C in various moved dispositions of the grasping beam 4.

Figure 7:
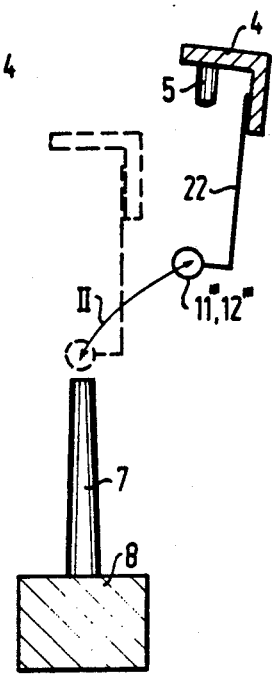

In the embodiment of FIG. 7, one light beam transmitter 11''' and one light beam receiver 12''' are mounted by an arm 22 to the grasper beam 4 immediately beneath the grasping members 5 in the area B, C, as in the embodiment of FIG. 6. No other light beam transmitter and receiver arrangement is provided in this embodiment, the grasper beam 4 being movable between the disposition shown in full lines spaced vertically and laterally away from the spindles 7 and the disposition shown in broken lines directly above the spindles 7 wherein the transmitter 11''' and the receiver 12''' are disposed within the area A. Accordingly, the single transmitter 11''' and receiver 12''' are adapted in this embodiment for monitoring both the area B, C and the area A by selective movement of the grasper beam 4.

Figure 8:
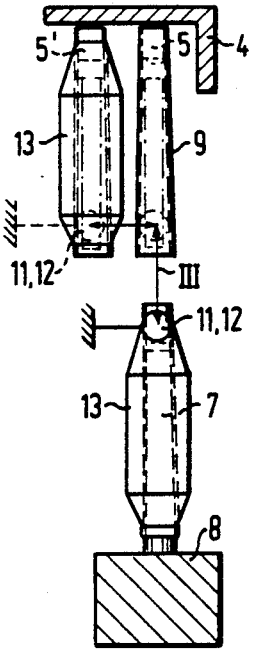

In the embodiment of FIG. 8, the bobbin exchanger is of the type having a grasper beam 4 equipped with two separate sets of grasping members 5, 5' for respectively grasping fully wound yarn tubes 13 and empty yarn tubes 9. Accordingly, in this embodiment, three separate areas must be monitored individually, an area immediately above the spindles 7 corresponding to the aforedescribed area A, an area immediately beneath the empty tube grasping members 5 corresponding to the aforedescribed area B, and an area immediately beneath the full tube grasping members 5' corresponding to the aforedescribed area C. In this embodiment, monitoring of these three areas is accomplished by a single light beam transmitter 11 and an associated light beam receiver 12 mounted either to the spinning machine end frame members or to the grasper beam 4 for shifting movement vertically and horizontally along the arrows III between the three areas.

Figure 9:
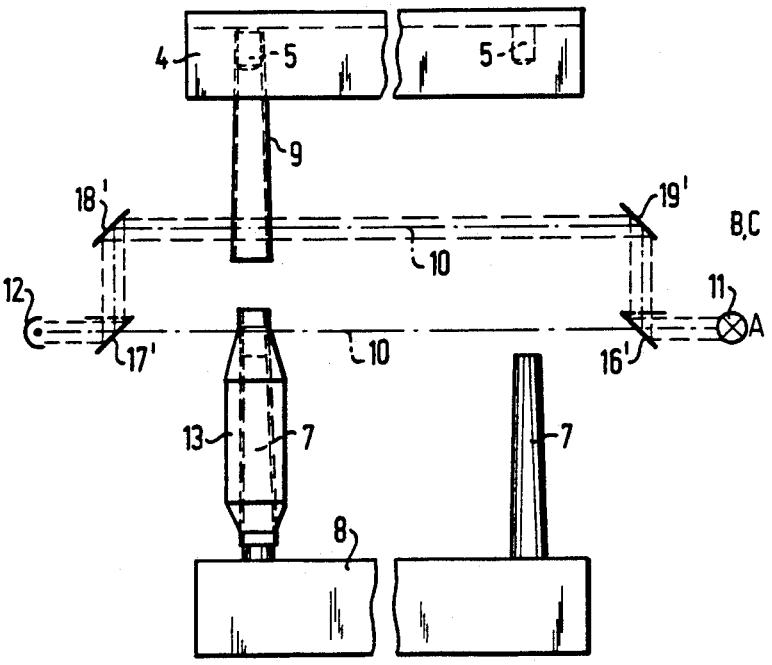

FIG. 9 illustrates in front elevation the spindle bearing plate 8, the spindles 7 and the grasper beam 4 and grasping members 5 of a spinning machine incorporating another embodiment of the present invention. In this embodiment, a single light beam transmitter 11 and a single light beam receiver 12 are utilized in conjunction with four mirrors 16', 17', 18', 19' for selectively directing the light beam 10 from the transmitter 11 either through the area A immediately above the spindles 7 or the area B, C directly beneath the grasping members 5 of the grasper beam 4. Specifically, the mirrors 16', 17' are pivotably mounted for selective movement between a first position shown in full lines wherein the mirrors extend into the path of the light beam 10 and a position shown in broken lines wherein the mirrors are out of the path of the light beam 10. The mirrors 18', 19' are disposed in horizontal alignment with the area B, C and in vertical alignment with the mirrors 16', 17'. Thus, in the disposition of the mirrors 16', 17' shown in full lines in FIG. 9, the light beam 10 is deflected through the area B, C for monitoring and determining the presence or absence of yarn tubes held by the grasping members 5 of the grasper beam 4 to determine the proper release of yarn tubes therefrom. On the other hand, when the mirrors 16', 17' are pivoted into their broken line disposition shown in FIG. 9, the light beam 10 is directed linearly from the transmitter 11 to the receiver 12 through the area A to monitor and determine the presence or absence of fully wound yarn tubes 13 on the spindles 7 to determine proper removal of the full tubes 13 by the grasping members 5.

Figure 10:
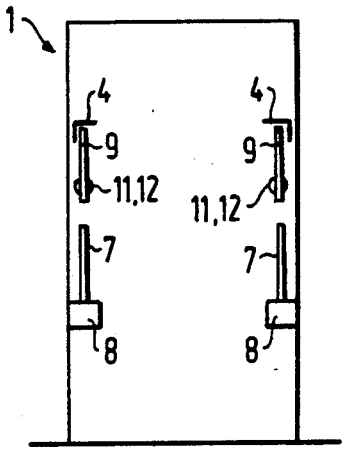

In FIG. 10, a ring spinning machine 1 is shown in vertical cross-section as viewed from one end of the machine. A light beam transmitter 11 and an associated light beam receiver 12 are mounted to the end frame members of the spinning machine 1 at an elevation corresponding to the aforedescribed monitoring area B, C beneath the grasper elements of the grasper beam 4. A separate pair of transmitter 11 and associated receiver 12 are provided for each side of the spinning machine 1.

Figure 11:
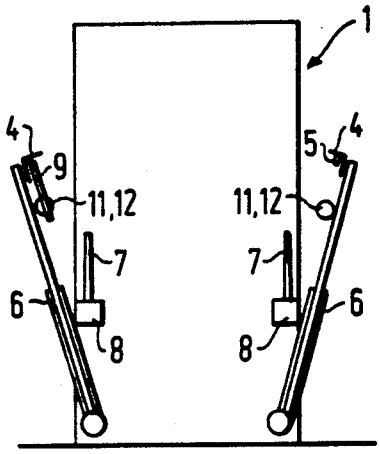

FIG. 11 is a similar vertical cross-sectional view of another ring spinning machine 1 wherein a light beam transmitter 11 and an associated light beam receiver 12 are mounted respectively at opposite ends of each grasper beam 4 at opposite sides of the spinning machine within the monitoring area B, C. As illustrated, the grasper beam 4 is shown in an outwardly pivoted disposition as determined by the longitudinal shaft on which the lever system 6 is mounted. As will be understood, the associated transmitter-receiver pairs direct their respective light beams through the respective areas B, C occupied by either empty or full yarn tubes, e.g. yarn tube 9, while held by the grasping members of the grasper beam 4 but unoccupied by yarn tubes after their release from the grasper beam 4. As will be recognized, the bobbin changer in each of FIGS. 10 and 11 has a single set of grasper members 5 corresponding to the number of spindles 7 of the spinning machine so that the same grasper members 5 are utilized in operation of the bobbin changer to grasp both empty yarn tubes 9 for supply to the spindles 7 and fully wound yarn tubes 13 for removal from the spindles 7. Accordingly, the monitoring areas B and C are identical as in the embodiments of FIGS. 4–7 above.

Figure 12:
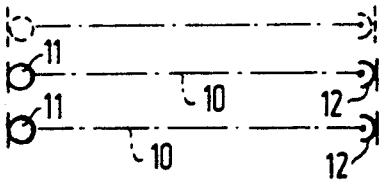

FIGS. 12–17 are schematic views illustrating various arrangements of light beam transmitters 11 and light beam receivers 12, as would be viewed in a front elevation on a spinning machine, for producing two or more light beams for monitoring the aforedescribed areas A, B, C. In FIG. 12, two separate pairs of associated light beam transmitters 11 and light beam receivers 12 are arranged at a vertical spacing from one another for generating two separate light beams 10 to respectively monitor the area A and coinciding areas B, C. A third pair of light beam transmitter 11 and light beam receiver 12 is shown in broken lines as would be provided for monitoring three separate areas A, B, C, as, for example, in the embodiment of FIG. 8. The transmitters 11 and receivers 12 of FIG. 12 would be mounted stationarily on the end frame members of a spinning machine.

Figure 13:
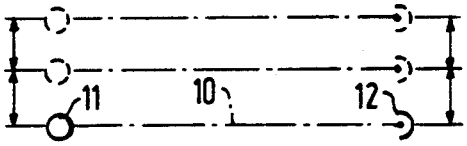

In FIG. 13, a single light beam transmitter 11 and a single light beam receiver 12 are mounted, e.g. to the end frame members of the spinning machine, for vertical shifting movement as indicated by the directional arrows between three separate dispositions of the transmitter 11 and receiver 12 to allow monitoring of three separate areas A, B, C.

Figure 14:
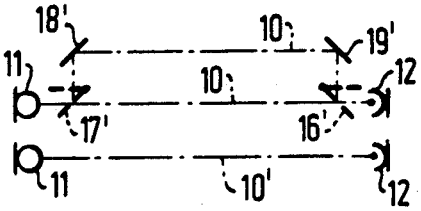

FIG. 14 schematically illustrates an embodiment analogous to that of FIG. 9 wherein one pair of associated light beam transmitter 11 and light beam receiver 12 are mounted stationarily to the spinning machine frame for directing a light beam 10, to monitor the area A adjacent the machine spindles and a separate pair of associated light beam transmitter 11 and light beam receiver 12 is mounted on the grasper beam 4 in association with a pair of pivotable mirrors 16', 17' and another pair of stationary mirrors 18', 19' for selectively directing a light beam 10 along two differing paths to monitor separate areas B and C.

Figure 15:
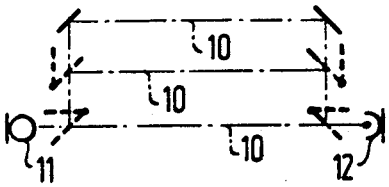

FIG. 15 schematically illustrates an embodiment wherein three pairs of mirrors, two pairs of which are selectively pivotable, are associated with a single pair of light beam transmitter 11 and light beam receiver 12 for selectively directing their light beam 10 along three separate paths for selectively monitoring three separate areas A, B, C.

Figure 16:
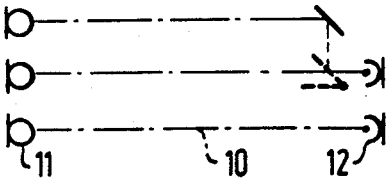
Figure 17:
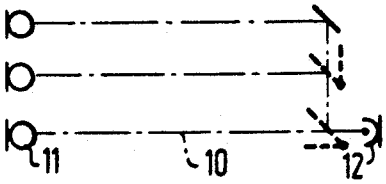

To reduce expense, FIGS. 16 and 17 schematically illustrate embodiments wherein the use of pivoted mirrors may be minimized. FIG. 16 corresponds generally to the embodiment of FIG. 14, the mirrors 17', 18' of FIG. 14 being eliminated in favor of a third light beam transmitter 11. FIG. 17 corresponds to the embodiment of FIG. 15, the three mirrors at the end of the spinning machine whereat the light beam transmitter 11 is provided in FIG. 15 being eliminated in favor of two additional light beam transmitters 11. As will be understood, it would also be possible to utilize a greater number of light beam receivers 12 than light beam transmitters 11, which would be preferable if the light beam transmitters 11 are relatively more expensive than the light beam receiver 12 such as would be the case if laser-producing transmitters are utilized.

Figure 18I:
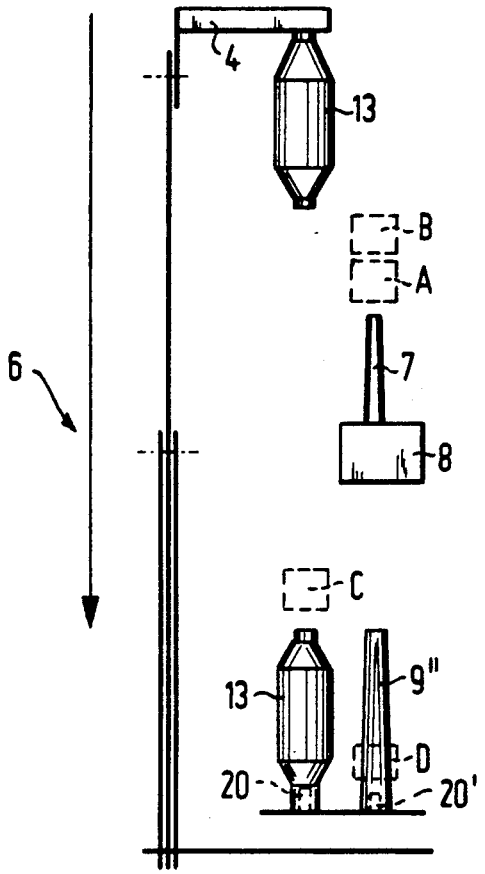
FIGS. 18I and 18III are schematic views illustrating another embodiment of the present invention.
Figure 18I:
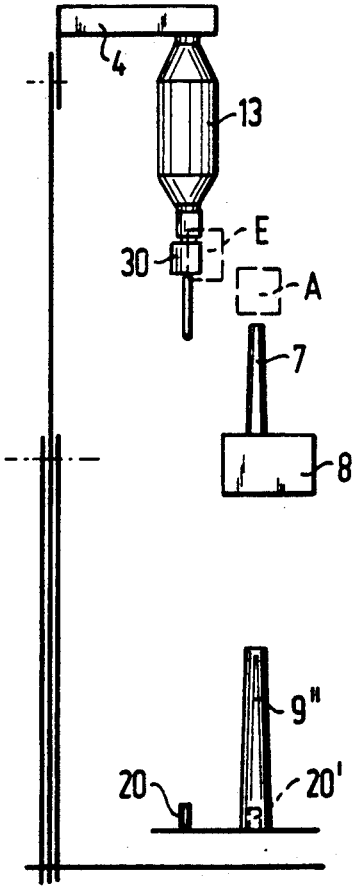
Figure 18:
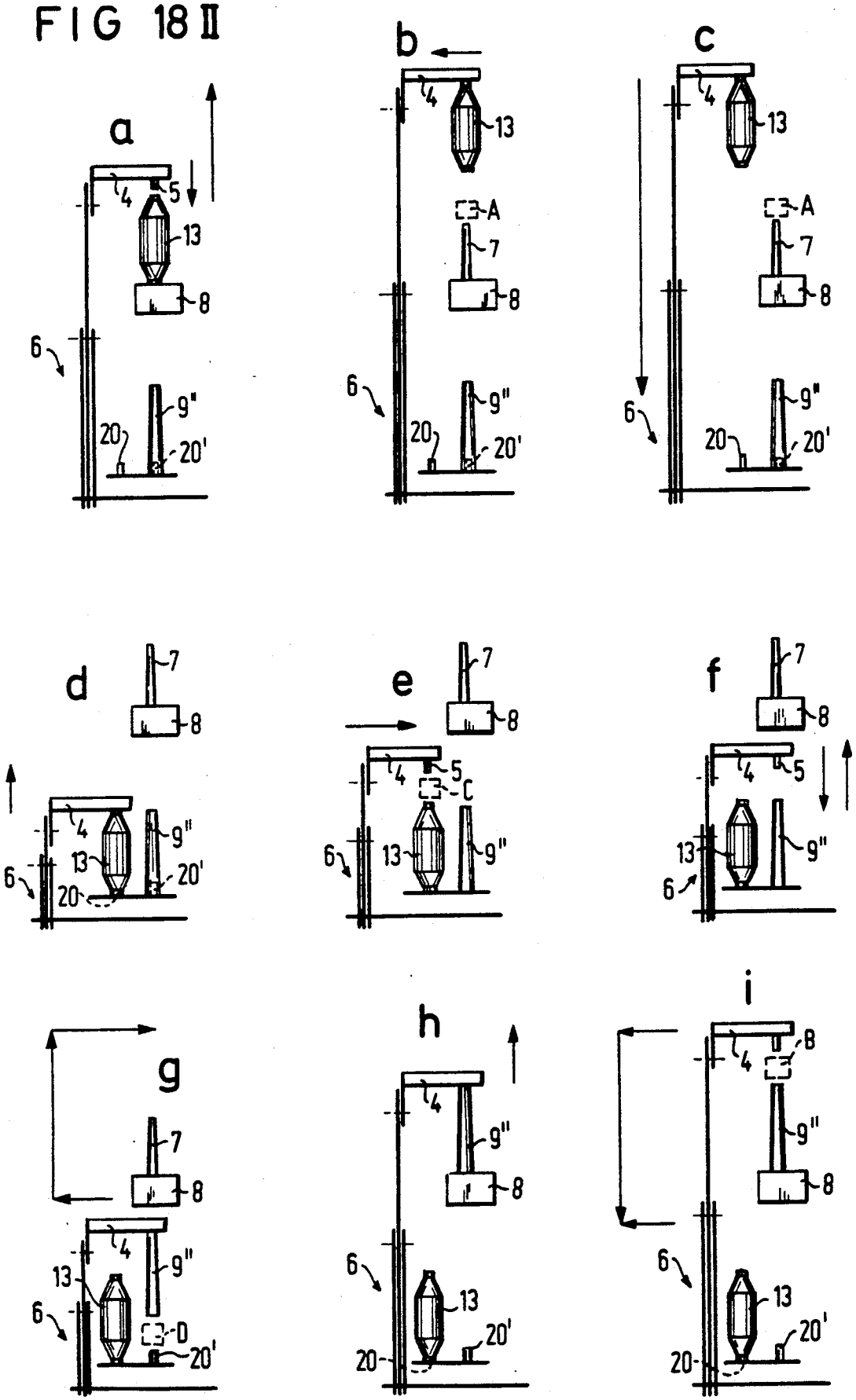

FIG. 18I schematically illustrates a spinning machine in end elevation wherein four separate areas A, B, C, D require monitoring. The spinning machine in this embodiment is associated with a conveyer belt having two sets of tube supporting pins 20, 20' for mounting thereon of fully wound yarn tubes 13 for transport away from the spinning machine 1 after removal from the spindles 7 and for mounting thereon of empty yarn tubes 9', for delivery to the spinning machine 1 for transfer onto the spindles 7 in replacement of the removed full tubes 13. As in the aforedescribed embodiments, an area A immediately above the upper tips of the spindles 7 of the spinning machine, which is occupied by yarn tubes when disposed on the spindles 7 but is unoccupied when yarn tubes are removed from the spindles 7, must be monitored. Similarly, an area D immediately above the empty tube support pins 20', which area is occupied by the empty tubes 9'' while supported on the pins 20' but is unoccupied by the tubes after removal therefrom, must be monitored. As will be understood, both areas A and D are stationary in relation to the end frame members of the spinning machine. An area B immediately vertically beneath the disposition of the grasper members of the grasper beam 4 when releasing empty yarn tubes 9'' onto the spindles 7, which area is occupied by the tubes 9'' while held by the grasping members but is unoccupied by yarn tubes after release therefrom, must be monitored. Likewise, an area C immediately beneath the disposition of the grasping members of the grasper beam 4 upon release of fully wound yarn tubes 13 onto the support pins 20 of the conveyer belt, which area C is occupied by the full tubes 13 while held by the grasper members but is unoccupied by the tubes after release therefrom, must be monitored. As will be understood, the areas D and C are stationary in relation to the grasper beam 4. In grasper beams 4 of the type having a single set of grasper members utilized for grasping both empty yarn tubes 9'' and fully wound yarn tubes 13, the areas B, C coincide.

The monitoring of the areas A, B, C, D of FIG. 18I are illustrated in FIGS. 18II(*a*) through 18II(*i*), wherein sequential steps in the bobbin exchange procedure carried out by the bobbin changer are shown. In FIG. 18II(*a*), the grasper beam 4 has been moved out of its normal stationary resting disposition immediately beneath the spindle bearing plate 8 into an elevated disposition above the spindles 7 preparatory to grasping the fully wound yarn tubes 13 by the grasping members 5 to remove them from the spindles 7. After grasping of the full yarn tubes 13 by the grasper members 5, the grasper beam 4 is elevated by the articulated lever system 6 into the disposition of FIG. 18II(*b*). As shown, empty replacement tubes 9'' are supported on the pin 20' of the conveyer belt directly beneath the spindle bearing plate 8. At this point in the bobbin exchange procedure, a light beam is directed through the area A above the spindles 7 previously occupied by the fully wound yarn tubes 13 to determine whether all of the full tubes 13 were actually removed from the spindles 7, which will be indicated if the light beam is uninterrupted. If, however, the light beam is interrupted, a failure signal is generated by the light beam receiver (not shown) and the associated controller stops further operation of the bobbin changer.

As will be understood by those persons skilled in the art, even when all fully wound yarn tubes 13 are removed from the spindles 7, it sometimes occurs that a component or components of the spindles 7 may separate from the spindle bearing structure 8 along with the fully wound tubes 13 when the grasper beam 4 is elevated into the disposition of FIG. 18II(*b*). If so, the spindle component or components will extend from the lower end of the fully wound yarn tubes 13 and will also interrupt the light beam in the area A. According the monitoring of the area A serves to recognize this potential problem as well.

Assuming all full yarn tubes 13 were properly removed by the grasper beam 4, the lever system 16 is operated to move the grasper beam 4 downwardly as shown in FIG. 18II(*c*) to the disposition of FIG. 18II(*d*) wherein the fully wound bobbins 13 are placed onto the support pins 20 of the conveyer belt. After release of the fully wound yarn tubes 13 from the grasper members 5 onto the support pins 20, the grasper beam 4 moves upwardly into the disposition of FIG. 18II(*e*), whereupon a light beam is directed through the area C immediately beneath the grasper members 5 to determine whether all fully wound yarn tubes 13 were properly released. If so, the light beam is uninterrupted and the operation of the bobbin changer continues. However, if one or more of the full tubes 13 was not released by the grasper members 5, the light beam will be interrupted causing the receiver to generate a failure signal and actuate stoppage of the bobbin changer.

From the disposition of FIG. 18II(*e*), the grasper beam 4 is moved laterally into the disposition of FIG. 18II(*f*) wherein the grasper members 5 are directly above the empty yarn tubes 9''. The grasper beam 4 is then lowered as indicated by the directional arrows for grasping of the empty yarn tubes 9'' by the grasper members 5 and the grasper beam 4 is then elevated once again to lift the empty yarn tubes 9'' from the support pins 20', as illustrated in FIG. 18II(*g*). At this point, a light beam is directed through the area D immediately above the support pins 20' to determine whether all of the empty yarn tubes 9'' were properly removed. If so, the light beam is uninterrupted and operation of the bobbin changer continues. However, if the light beam is interrupted by an empty yarn tube 9'' remaining on its support pin 20', the light beam receiver generates a failure signal causing stoppage of the bobbin changer. Of course, as will be understood, the conveyer must provide separate parallel rows of support pins 20, 20' for respectively supporting fully wound yarn tubes 13 and empty yarn tubes 9'' in laterally spaced rows for the monitoring of the area D to be effective in this manner.

From the disposition of the grasper beam in FIG. 18II(*g*), the grasper beam is moved by the articulated lever system 6 as indicated by the directional arrows to return the grasper beam 4 to a disposition above the spindles 7. The grasper beam 4 is then lowered to place the empty yarn tubes 9'' onto the spindles 7, as shown in FIG. 18II(*h*). After operation of the grasper members 5 to release the yarn tubes 9'', the grasper beam 4 is again elevated into the disposition of FIG. 18II(*i*), whereupon a light beam is directed through the area B immediately beneath the grasper members 5 to determine whether all of the empty tubes 9'' were properly released onto the spindles 7. If so, the light beam is uninterrupted and the operation of the bobbin changer continues to return the grasper beam 4 to its resting disposition beneath the spindle bearing plate 8, as indicated by the directional arrows. However, if the light beam is interrupted by an empty yarn tube 9'' remaining held by its grasping member 5, the light beam receiver transmits a failure signal to the associated controller which stops further operation of the bobbin changer.

As illustrated in FIG. 18III, it is possible that the direction of the monitoring light beam through the area A may not be carried out until after the fully wound yarn tubes 13 have been moved laterally from immediately above the spindles 7, which would be advantageous to prevent the possibility of yarns extending downwardly from the tubes 13 possibly interrupting the light beam and producing a false failure signal so as to avoid an unnecessary stoppage of the continuing operation of the bobbin changer. However, in such circumstance, the monitoring of the area A will not enable recognition of the possibility that components of the spindle 7 may have been removed from the spindle bearing plate 8 along with the fully wound yarn tubes 13, as representatively illustrated in FIG. 18III. Accordingly, it is advantageous to provide a light beam through another area E beneath a disposition of the fully wound yarn tubes 13 while held by the grasping members of the grasper beam 4 after elevation and lateral displacement from the spindles 7, for the specific purpose of determining whether componentry 30 of the spindle 7 was improperly removed from the spindle bearing plate 8. Thus, potential damage to the bobbin changer and to other elements of the spinning machine may be prevented in a simple and effective manner.

Figure 20:
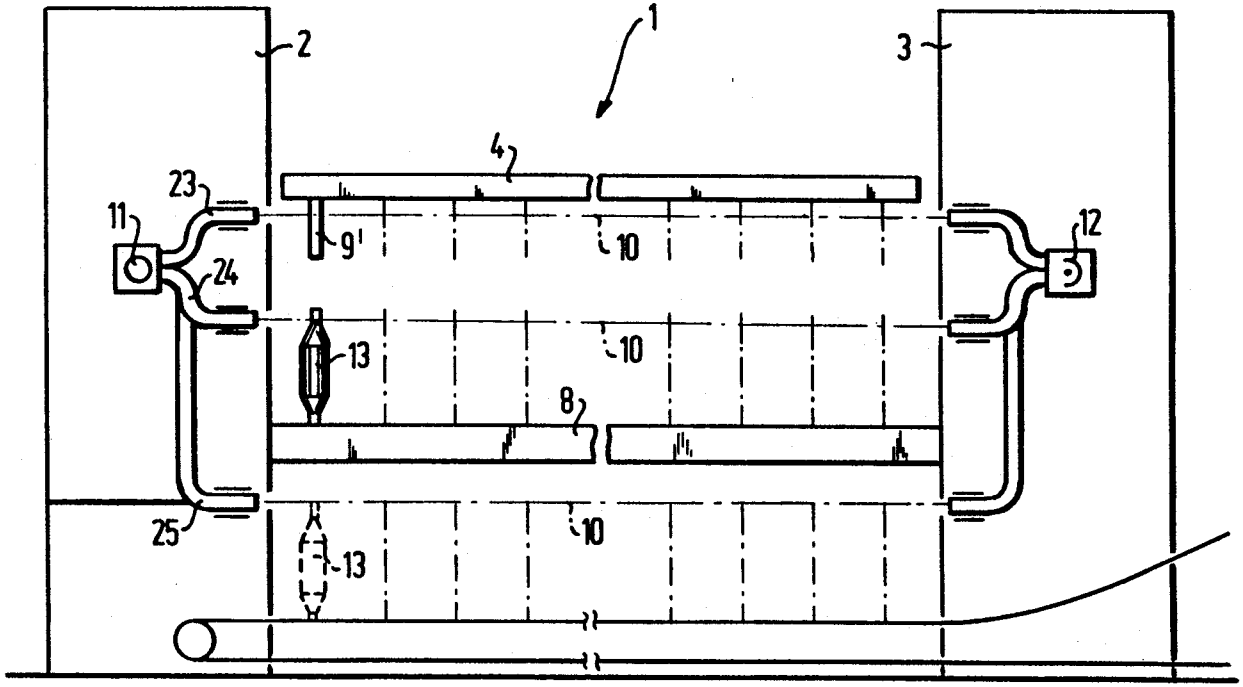
FIGS. 19 and 20 are schematic side and front elevational views, respectively, showing another embodiment of the present invention.
Figure 19:
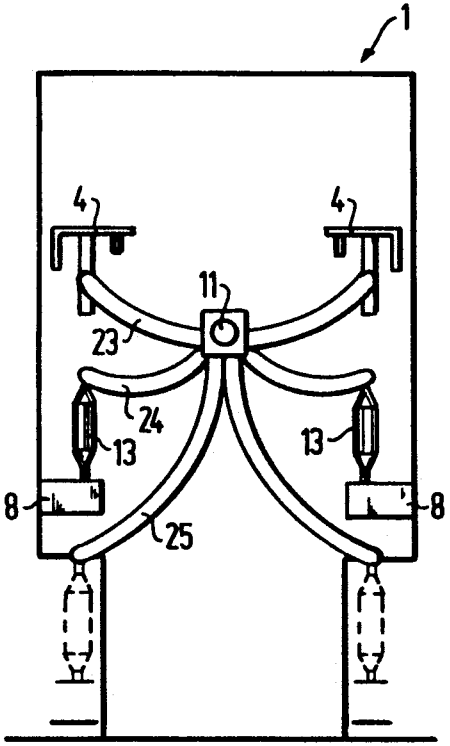

FIGS. 19 and 20 illustrate embodiments of the present invention wherein light wave guide arrangements 23, 24, 25 are utilized in conjunction with a single light beam transmitter 11 and a single light beam receiver 12 mounted to the respective end frame members 2, 3 of a spinning machine 1 for directing separate light beams 10 along multiple different paths. Each light beam guiding arrangement 23, 24, 25 includes a conduit within which is provided at least two light leads corresponding ends of which are respectively associated with a light source and a photosensor while the other ends are directed from the transmitter area 11 to the receiver area 12.

It is contemplated that any of a variety of light beam transmitters may be utilized in accordance with the present invention. For example, transmitters which generate either visible or invisible light may be utilized. With ring spinning or ring twisting machines having a high number of spindles arranged in extremely long rows, the quality of a light beam of an incoherent light source may be insufficient over the distance it would be required to travel along the full length of the spindle rows and, accordingly, it may be preferable in such embodiments to utilize a transmitter which produces a laser beam of light. For example, laser diodes offer the advantage of compact design and simple adjustability.

It is also contemplated that fiber optic technology may be utilized in conjunction with a laser light beam in accordance with the present invention, utilizing an arrangement including a light source, a photo-conductive medium, and a transmitter and receiver. The light source preferably is a coherent light source such as a helium-neon laser. Optical fibers with a high transmission in the visual spectral range, preferably single-mode glass fibers with a small core diameter, are utilized as the photo-conductive medium. The transmitter is a lens which bundles and radiates the light exiting from the optical fiber and a silicon photo-detector with a large active surface connected with electronic amplifier circuitry is utilized as the receiver.

Such a light beam monitoring arrangement operates in the following manner. The light exiting from the laser is divided into several partial light beams by means of beam-divider plates. Each partial beam is directed to strike a lens, which transmits the light onto the end surface of a glass fiber core. Depending upon the intended usage, the partial laser light beams are transmitted via glass fibers of varying length until the light exits the fiber at its intended destination at a well defined fiber-specific opening angle whereat the light is refocused and parallelized by means of another lens, such as an achromatic lens. At the same time, the light beam is widened and its beam divergence reduced so that the widened beam spans the work area to be monitored and finally strikes the receiver. The light beam receiver is arranged to carry out a switching function when the light beam is interrupted, e.g. by an empty yarn tube 9 or a fully wound yarn tube 13 or another like object.

This laser light beam system serves to monitor the bobbin changer in the ring spinning machine. As in the aforedescribed embodiments, the proper execution by the bobbin changer for removing fully wound yarn tubes 13 from the machine spindles and for delivering and releasing empty yarn tubes 9 onto the spindles is monitored. The overall monitoring process typically lasts approximately five minutes, during which the laser beam system is in its operating phase. However, the laser beam is actually transmitted for only a few seconds as the monitoring process requires. Appropriate transmitters 11 and receivers 12 are installed at the previously described dispositions and are equipped with cover shields which serve to suppress outside light and also to prevent direct viewing of the laser beam.

It will therefore be readily understood by those persons skilled in the art that the present invention is susceptible of a broad utility and application. Many embodiments and adaptations of the present invention other than those herein described, as well as man variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of monitoring an automatic bobbin changer of the type selectively operable for simultaneously grasping and then simultaneously releasing a plurality of yarn tubes for selective supply and removal of yarn tubes to and from a ring spinning machine, ring twisting machine and like textile machines, said method comprising the steps of: (a) after an operation of the bobbin changer for grasping a plurality of yarn tubes, directing a first light beam through an area previously occupied by the tubes upon which the grasping operation was performed, determining whether the first light beam is interrupted by any tube which the bobbin changer failed to grasp, and generating a failure signal when interruption of the first light beam is determined, and (b) after an operation of the bobbin changer for releasing a plurality of grasped tubes, directing a second light beam through an area previously occupied by the tubes which were released, determining whether the second light beam is interrupted by any tube which the bobbin changer failed to release, and generating a failure signal when interruption of the second light beam is determined.

2. The method of claim 1, wherein the textile machine has a plurality of spindles for supporting yarn tubes for yarn winding thereabout and the bobbin changer is operative for grasping and removing yarn tubes from the spindles when the tubes are fully wound with yarn, characterized further in that the step of directing a first light beam after a grasping operation of the bobbin changer comprises directing the first light beam in an area adjacent the spindles occupied by the fully wound tubes while supported on the spindles before removal.

3. The method of claim 2, wherein the bobbin changer includes grasping members for holding the fully wound yarn tubes after removal from the spindles of the textile machine and for subsequently releasing the fully wound tubes at a discharge location ,characterized further in that the step of directing a second light beam after a releasing operation of the bobbin changer comprises directing the second light beam in an area adjacent the grasping members occupied by the fully wound tubes while held by the grasping members before release.

4. The method of claim 1, wherein a plurality of support pins are provided for storing a plurality of empty yarn tubes for supply to the textile machine and the bobbin changer is operative for grasping and removing the empty yarn tubes from the support pins, characterized further in that the step of directing a first light beam after a grasping operation of the bobbin changer comprises directing the first light beam in an area adjacent the support pins occupied by the empty tubes while stored thereon before removal.

5. The method of claim 4, wherein the bobbin changer includes grasping members for holding the empty tubes after removal from the support pins and for subsequently releasing the empty tubes to the textile machine, characterized further in that the seep of directing a second light beam after a releasing operation of the bobbin changer comprises directing the second light beam in an area adjacent the grasping members occupied by the empty tubes while held by the grasping members before release.

6. The method of claim 1 and characterized further in that each light beam directing step is performed at a sufficient time delay after the respective grasping or releasing operation of the bobbin changer for displacement from the light beam area of the yarn tubes upon which the operation was performed.

7. The method of claim 2 and characterized further in that the step of directing a first light beam after a grasping operation of the bobbin changer is not performed until a fully wound tube is removed from the light beam area.

8. The method of claim 2 and characterized further by, after an operation of the bobbin changer for grasping and removing fully wound tubes from the spindles, directing another light beam in another area for determining accidental removal of a part of a spindle from the textile machine.

9. The method of claim 3 or 5 and characterized further by generating the first and second light beams successively at said areas.

10. The method of claim 3 or 5 and characterized further by providing at least one light beam transmitter and at least one light beam receiver and shifting at least one thereof to direct the first and second light beams at said areas.

11. The method of claim 3 or 5 and characterized further by providing a light beam transmitter and a light beam receiver and selectively deflecting the light beam along at least two paths therebetween to produce the first and second light beams.

12. The method of claim 2 or 4 and characterized further by providing a stationary light beam and moving the bobbin changer relative thereto to produce the first and second light beams.

13. In combination with a textile ring spinning machine, ring twisting machine, and like textile machines, and an automatic bobbin changer of the type having a plurality of grasping members selectively operable for simultaneously grasping and then simultaneously releasing a plurality of yarn tubes for selective supply and removal of yarn tubes to and from the textile machine, apparatus for monitoring the bobbin changer comprising (a) means operative after an operation of the bobbin changer for grasping a plurality of tubes for generating and directing a first light beam through an area previously occupied by the tubes upon which the bobbin changer performed the tube grasping operation and operative after an operation of the bobbin changer for releasing a plurality of grasped tubes for generating and directing a second light beam through an area previously occupied by tubes upon which the bobbin changer performed the tube releasing operation and (b) means associated with the light beam generating and directing means for determining whether the first light beam is interrupted by any tube which the bobbin changer failed to grasp, for determining whether the second light beam is interrupted by any tube which the bobbin changer failed to release, and for generating a failure signal when interruption of either light beam is determined.

14. Apparatus for monitoring an automatic bobbin changer according to claim 13, wherein the textile machine has a plurality of spindles for supporting yarn tubes for yarn winding thereabout and the bobbin changer is operative for grasping and removing yarn tubes from the spindles when the tubes are fully wound with yarn, and wherein the bobbin changer has a support feebler carrying the grasping members, said monitoring apparatus being characterized further in that said light beam generating and directing means is mounted on the support member of the bobbin changer and the support member is movable for directing the first light beam in an area adjacent the spindles occupied by fully wound tubes while supported on the spindles before removal.

15. Apparatus for monitoring and automatic bobbin changer according to claim 13, wherein the textile machine has a plurality of spindles for supporting yarn tubes for yarn winding thereabout and the bobbin changer is operative for grasping and removing yarn tubes from the spindles when the tubes are fully wound with yarn, and wherein said light beam generating and directing means is mounted on the textile machine within the range of operative movements of the bobbin changer, said monitoring apparatus being characterized further by means for shifting said light beam generating and directing means between a position for directing the first light beam in an area adjacent the spindles occupied by fully wound tubes while supported on the spindles before removal and a position for directing the second light beam in an area adjacent the grasping members occupied by yarn tubes held by the grasping members before release.

16. Apparatus for monitoring an automatic bobbin changer according to claim 15, and characterized further in that said shifting means includes a threaded drive screw and a controllable motor associated therewith.

17. Apparatus for monitoring an automatic bobbin changer according to claim 13, and characterized further in that said light beam generating and directing means includes a pair of pivotable mirrors for selectively deflecting a single light beam of said light beam generating and directing means along differing paths to produce the first and second light beams.

18. Apparatus for monitoring an automatic bobbin changer according to claim 13, and characterized further in that said light beam generating and directing means includes three pairs of mirrors for deflecting a single light beam of said light beam generating and directing means, at least one pair of said mirrors being selectively pivotable for movement into and out of a beam deflecting disposition.

19. Apparatus for monitoring an automatic bobbin changer according to claim 13, and characterized further by plural light beam generating and directing means.

20. Apparatus for monitoring an automatic bobbin changer according to claim 13, and characterized further in that said light beam generating and directing means generating visible light.

21. Apparatus for monitoring an automatic bobbin changer according to claim 20, and characterized further in that said light beam generating and directing means includes light wave guiding means.

22. Apparatus for monitoring a automatic bobbin changer according to claim 13, and characterized further in that said light beam generating and directing means generates invisible light.

23. Apparatus for monitoring an automatic bobbin changer according to claim 22, and characterized further in that said light beam generating and directing means includes light wave guiding means.

24. Apparatus for monitoring an automatic bobbin changer according to claim 13, and characterized further in that said light beam generating and directing means generates a laser beam.

25. Apparatus for monitoring an automatic bobbin changer according to claim 24, and characterized further in that said light beam generating and directing means includes a beam widening lens.

* * * * *